US010239599B1

(12) United States Patent
Biel et al.

(10) Patent No.: US 10,239,599 B1
(45) Date of Patent: Mar. 26, 2019

(54) STERN DRIVE ARRANGEMENTS HAVING IDLE RELIEF EXHAUST GAS BYPASS

(71) Applicant: Brunswick Corporation, Lake Forest, IL (US)

(72) Inventors: Michael J. Biel, Beaver Dam, WI (US); Andrew S. Waisanen, Fond du Lac, WI (US); Jeffrey C. Etapa, Oakfield, WI (US); Bret A. Martin, Wellington, FL (US); Daniel E. Clarkson, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 172 days.

(21) Appl. No.: 15/427,478

(22) Filed: Feb. 8, 2017

(51) Int. Cl.

| | |
|---|---|
| ***B63H 21/32*** | (2006.01) |
| ***B63H 21/14*** | (2006.01) |
| ***F02B 61/04*** | (2006.01) |
| ***F01N 13/00*** | (2010.01) |
| ***F01N 13/10*** | (2010.01) |

(52) U.S. Cl.
CPC ..... *B63H 21/32* (2013.01); *B63H 21/14* (2013.01); *F01N 13/004* (2013.01); *F01N 13/007* (2013.01); *F01N 13/10* (2013.01); *F02B 61/04* (2013.01); *B63B 2758/00* (2013.01); *F01N 2410/00* (2013.01)

(58) Field of Classification Search
CPC .. F01N 13/007; F01N 2410/00; F01N 13/004; F01N 13/10; B63H 21/32; B63H 21/14; F02B 61/04; B63B 2758/00
See application file for complete search history.

(56) References Cited

U.S. PATENT DOCUMENTS

| | | | | |
|---|---|---|---|---|
| 4,002,136 | A | 1/1977 | Michalak | |
| 4,773,215 | A | 9/1988 | Winberg et al. | |
| 4,960,398 | A * | 10/1990 | Potratz | B63H 20/20 440/53 |
| 4,995,233 | A * | 2/1991 | Lulloff | B63H 20/245 440/89 G |
| 5,348,500 | A | 9/1994 | Lassanske | |
| 5,372,109 | A * | 12/1994 | Thompson | F02D 9/06 123/323 |
| 5,421,756 | A | 6/1995 | Hayasaka | |
| 6,220,907 | B1 * | 4/2001 | Shimizu | B63H 21/32 440/89 G |
| 6,299,496 | B1 | 10/2001 | Griffiths et al. | |
| 8,876,566 | B1 | 11/2014 | Hilbert et al. | |
| 9,376,194 | B1 | 6/2016 | Jensen et al. | |
| 2009/0269999 | A1 | 10/2009 | Schaub et al. | |

* cited by examiner

*Primary Examiner* — Brandon D Lee
(74) *Attorney, Agent, or Firm* — Andrus Intellectual Property Law, LLP

(57) ABSTRACT

A stern drive arrangement is for propelling a marine vessel in water. A diverter valve is movable into and between an open position in which the exhaust gas is allowed to flow through the above-water outlet via the secondary exhaust conduit and a closed position in which the exhaust gas is at least partially prevented from flowing through an above-water outlet via a secondary exhaust conduit. Via a bypass conduit, the exhaust gas in the secondary exhaust conduit can bypass the diverter valve and discharge to atmosphere when the diverter valve is in the closed position.

20 Claims, 4 Drawing Sheets

STERN DRIVE ARRANGEMENTS HAVING IDLE RELIEF EXHAUST GAS BYPASS

FIELD

The present disclosure relates to stern drive arrangements and particularly to exhaust systems for stern drive arrangements.

BACKGROUND

The following U.S. patents are incorporated herein by reference.

U.S. Pat. No. 4,773,215 discloses a stern drive marine propulsion system that has an inboard engine with an exhaust, an outboard drive unit operatively coupled to the engine and separated therefrom by a transom having two exhaust passages there through, and an exhaust control assembly aft of the engine exhaust and forward of the transom and within the boat. The assembly has an inlet connected to the engine exhaust, and has first and second outlets communicating with the respective exhaust passages extending aft through the transom. A valve in the assembly selectively controls communication of the inlet with the first outlet.

U.S. Pat. No. 4,995,233 discloses a stern drive marine propulsion system having an inboard engine, an outboard drive unit and propeller operatively coupled to the engine and separated therefrom by a transom having two exhaust passages there through. An exhaust control assembly has an inlet connected to the engine exhaust, first and second outlets communicating with respective exhaust passages extending aft through the transom, and a valve in the assembly having a first condition providing communication of the inlet with the first outlet, and a second condition blocking communication of the inlet with the first outlet. Automatic control circuitry automatically controls actuation of the valve between the first and second conditions in response to a given parameter.

U.S. Pat. No. 6,299,496 discloses an exhaust control system for a propulsion system used on a marine vessel. Several parameters are monitored by a controller and the controller uses the information provided by these sensors to control the position of a valve within an exhaust conduit assembly. Sound level is measured at a preselected position on the marine vessel and the degree of opening of the valve is controlled to limit the noise level emanating from the exhaust system. Some exhaust can be diverted directly to the atmosphere through the transom as long as the noise level does not exceed a preselected limit, which can typically be a state law regulation. If a noise level is exceeded, the controller forces the exhaust through an underwater discharge point, typically through the propeller hub of the marine propulsion system.

U.S. Pat. No. 8,876,566 discloses a marine drive and marine exhaust pipe that include a main exhaust flow chamber and an auxiliary idle relief chamber. The auxiliary idle relief chamber vents exhaust above the surface of the body of water in which the vessel is operating.

U.S. Pat. No. 9,376,194 discloses secondary mufflers configured to discharge exhaust gases from an outboard motor to atmosphere surrounding the outboard motor when an internal combustion engine of the outboard motor is operated at idle and at low speeds. The secondary mufflers comprise a housing having an open interior, an inlet port configured to convey the exhaust gases to the open interior, and an outlet port configured to discharge the exhaust gases from the open interior. An exhaust grommet is connected to the outlet port. The exhaust grommet comprises a body that is configured to engage with a cowl of the outboard motor and an extension that extends through the outlet port and protrudes into the open interior. The extension and the body together define a through-bore that is configured to convey the exhaust gases from the open interior to the atmosphere.

U.S. Patent Application Publication No. 2009/0269999 discloses a silencing system for a marine exhaust system that incorporates a single muffler for each engine of the marine vessel. The muffler is provided with two sound dampening chambers interconnected by several exhaust openings between the chambers. A Y-shaped exhaust type system directs exhaust streams from both sides of an engine toward a single exhaust conduit which extends through a transom of the marine vessel. The muffler is provided with a drain opening that allows water to flow out of the first chamber of the muffler in order to maximize the available volume within that chamber for use in sound attenuation. The outlet of the second chamber is provided with a baffle plate that directs the flow of exhaust gas in a forward direction toward the transom of the marine vessel and a deflection surface that directs the exhaust gas to flow in a downward direction toward the surface of the body of water in which the marine vessel is operated.

U.S. patent application Ser. No. 15/174,201, filed Jun. 6, 2016, discloses an intake system for a marine drive. The intake system comprises a throttle device that receives intake air for combustion; an intake conduit that conveys the intake air to the throttle device, wherein the intake conduit has an upstream inlet end, a downstream outlet end, and a radially outer surface that extends from the upstream inlet end to the downstream outlet end; and an intake silencer coupled to the radially outer surface and configured to attenuate sound emanating from the intake system.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A stern drive arrangement is for propelling a marine vessel in water. The stern drive arrangement comprises an internal combustion engine; an exhaust manifold that conveys exhaust gas from the internal combustion engine; a primary exhaust conduit configured to convey the exhaust gas from the exhaust manifold to an underwater outlet on one of the stern drive arrangement and the marine vessel; and a secondary exhaust conduit configured to convey the exhaust gas from the exhaust manifold to an above-water outlet on one of the stern drive arrangement and the marine vessel. A diverter valve is movable into and between an open position in which the exhaust gas is allowed to flow through the above-water outlet via the secondary exhaust conduit and a closed position in which the exhaust gas is at least partially prevented from flowing through the above-water outlet via the secondary exhaust conduit. Via a bypass conduit, the exhaust gas in the secondary exhaust conduit can bypass the diverter valve and discharge to atmosphere when the diverter valve is in the closed position.

BRIEF DESCRIPTION OF THE DRAWINGS

Examples of stern drive arrangements are described with reference to the following drawing figures. The same numbers are used throughout the drawing figures to reference like features and components.

DETAILED DESCRIPTION OF THE DRAWINGS

Figure 1:
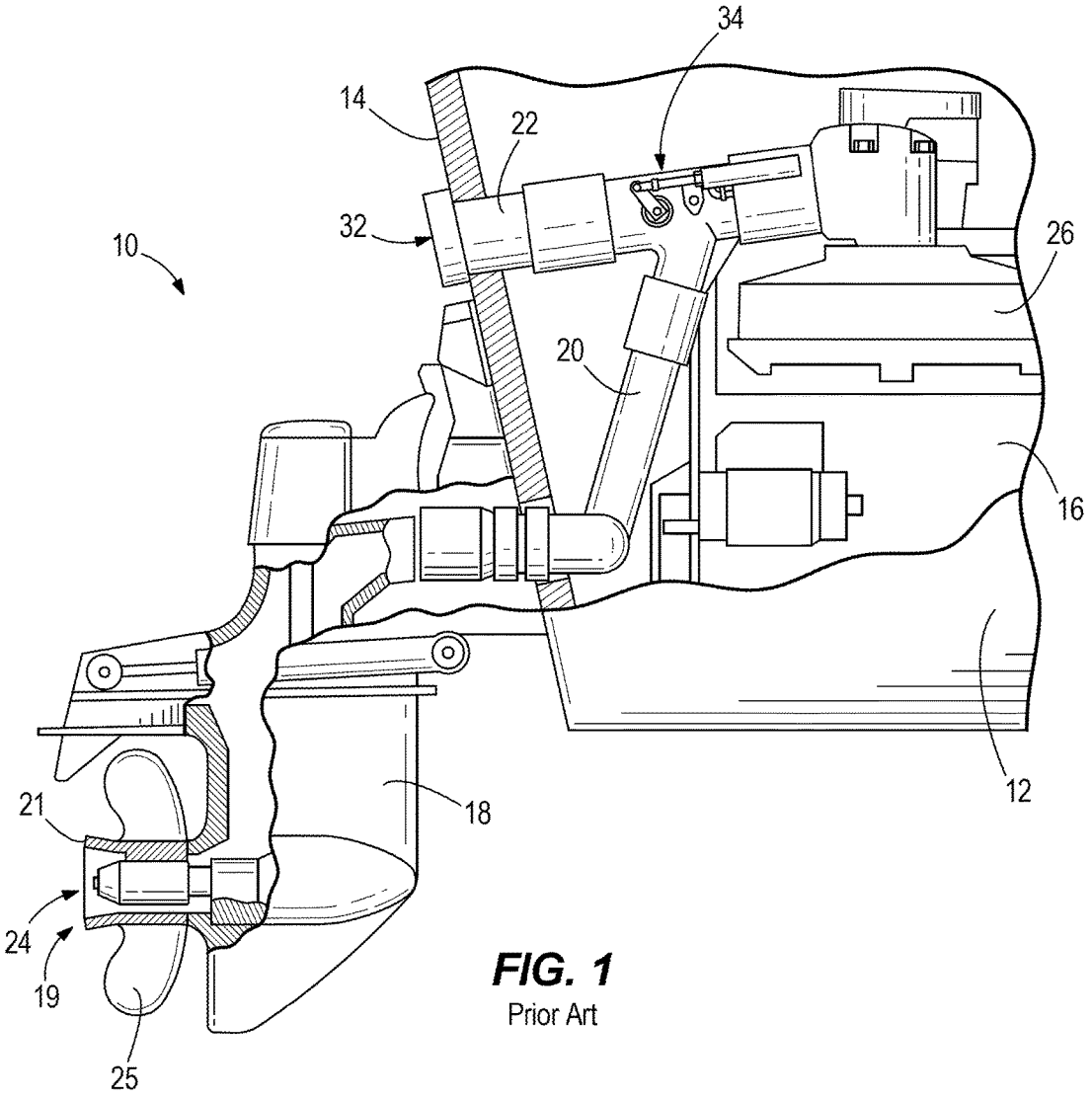
FIG. 1 Prior Art
FIG. 1 is a depiction of a stern drive, taken from U.S. Pat. No. 6,299,496.

FIG. 1 is taken from U.S. Pat. No. 6,299,496 and depicts a stern drive arrangement 10 for propelling a marine vessel 12 in water. The stern drive arrangement 10 extends through the transom 14 of the marine vessel 12 and includes an internal combustion engine 16 located in the marine vessel 12 and a drive unit including a driveshaft housing and lower gearcase 18 that extends outwardly from the marine vessel 12 into the surrounding water. A propeller 19 having a hub 21 and a plurality of propeller blades 25 is supported by the driveshaft housing and lower gearcase 18. A (not-depicted) conventional driveshaft and transmission assembly operatively couples the internal combustion engine 16 to the propeller 19 such that operation of the internal combustion engine 16 causes rotation of the propeller 19.

A pair of exhaust manifolds 26 (only one is shown in FIG. 1) conveys exhaust gas away from the internal combustion engine 16. The pair of exhaust manifolds 26 are connected to a primary exhaust conduit 20 and a secondary exhaust conduit 22, which together convey the exhaust gas from upstream to downstream and in parallel for discharge from the stern drive arrangement 10. The primary exhaust conduit 20 merges and conveys the exhaust gas from the pair of exhaust manifolds 26 to an underwater outlet 24 on the stern drive arrangement 10, which in this example is formed through the driveshaft housing and lower gearcase 18 and through the hub 21 of the propeller 19. The secondary exhaust conduit 22 (there can be more than the one shown) conveys the exhaust gas from the pair of exhaust manifolds 26 to an above-water outlet 32, which in this example is formed through the transom 14 of the marine vessel 12. In other examples, the above-water outlet 32 can be formed through the port or starboard sides of the marine vessel 12 and/or through the stern drive arrangement 10, such as through the noted driveshaft housing and/or a transom bracket for connecting the stern drive arrangement 10 to the transom 14 of the marine vessel 12. As will be evident from the examples described herein below, the locations and configurations of the primary and secondary exhaust conduits 20, 22, the underwater outlet 24 and the above-water outlet 32 can vary from that which is shown in FIG. 1.

One or more diverter valves 34 are located in the respective secondary exhaust conduit(s) 22. The diverter valve 34 is moveable into and between an open position in which the exhaust gas is allowed to flow through the respective secondary exhaust conduit 22 and out of the above-water outlet 32, and a closed position in which the exhaust gas is prevented from flowing through the secondary exhaust conduit 22 and out the above-water outlet 32. The diverter valve 34 is configured to limit the amount of exhaust noise from emanating from the stern drive arrangement 10. In some examples, the diverter valve 34 can be opened during idle and/or low speed operation of the stern drive arrangement 10, when the surrounding water presents significant resistance to flow of exhaust gas out of the underwater outlet 24, to thereby permit "idle relief" of exhaust gases. The diverter valve 34 can be closed when the stern drive arrangement 10 is operated at higher speeds so that the majority of the exhaust gases are discharged via the underwater outlet 24 and thus the amount of noise emanating from the stern drive arrangement 10 is limited. Additional mufflers/silencers, such as described in the above-incorporated patents, can be located on the secondary exhaust conduit 22 to further limit noise. In some examples, the position of the diverter valve 34 can be actively controllable by a computer controller and optionally by a user input device that communicates user inputs to the controller. The user input device can, for example be located at the helm of the marine vessel 12, such as described in the above-incorporated U.S. Pat. No. 6,299,496.

During research and development with exhaust systems for marine propulsion devices, such as for example the stern drive arrangements described herein above with respect to U.S. Pat. No. 6,299,496, the present inventors have identified several areas for improvement. The present inventors have determined that flow of exhaust gases through the stern drive arrangement can undesirably cause noise and/or vibration in the secondary (above water) exhaust conduit. More specifically, the unwanted noise and vibration can be particularly acute during "quiet modes" of the system, when the diverter valve for the secondary exhaust conduit is in its closed position. In some examples, the noise and/or vibration was found to originate from uncontrolled flow (i.e. leaks) of exhaust gas around the closed diverter valve. In some examples, the noise and/or vibration was found to originate from the diverter valve, which was found to rattle during certain operational states. In some examples, the noise and/or vibration was found to originate from exhaust gas bubbling through the underwater exhaust outlet on the stern drive, for example via the propeller hub.

During their continued efforts to improve upon these systems, the present inventors arrived at the concepts of the present disclosure, which are aimed at overcoming the drawbacks discussed herein above.

Figure 2:
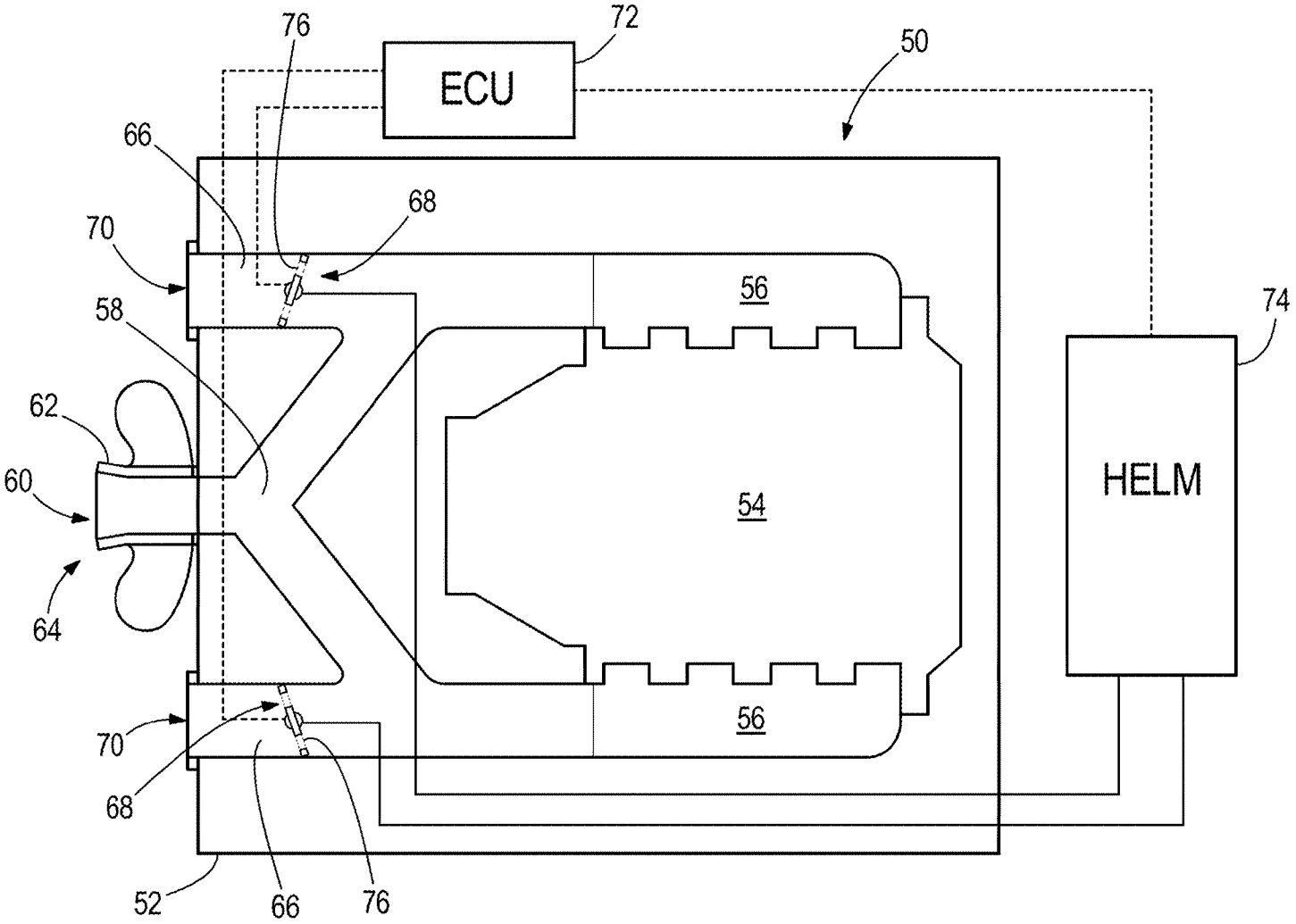
FIG. 2 is a schematic view of a first embodiment according to the present disclosure.

FIG. 2 is a schematic depiction of a first embodiment of a stern drive arrangement 50 according to the present disclosure. The stern drive arrangement 50 is configured to propel a marine vessel 52 in water, and includes an internal combustion engine 54 and a pair of exhaust manifolds 56 that each convey exhaust gas from the internal combustion engine 54. A primary exhaust conduit 58 is configured to merge and convey the exhaust gas from the pair of exhaust manifolds 56 to an underwater outlet 60 on the stern drive arrangement 50. In the illustrated example, the underwater outlet 60 is formed through the hub 62 of a propeller 64, which is caused to rotate by combustion in the internal combustion engine 54. In this manner, the primary exhaust conduit 58 merges the exhaust gas from the pair of exhaust manifolds 56 and then discharges the exhaust gas via the underwater outlet 60.

A pair of secondary exhaust conduits 66 each convey the exhaust gas form the pair of exhaust manifolds 56, respectively. A corresponding pair of diverter valves 68 are disposed in the respective secondary exhaust conduits 66. Each diverter valve 68 is moveable into and between an open position (not shown) in which the exhaust gas is allowed to flow through the secondary exhaust conduit 66 and to atmosphere via an above-water outlet 70 on the marine vessel 50 and a closed position (see FIG. 2) in which the exhaust gas is at least partially prevented from flowing through the secondary exhaust conduit 66. As explained herein above, movement of the diverter valves 68 into and between the noted open and closed positions can be controlled via computer controller 72, such as engine control unit (ECU), which optionally can receive electronic commands from a user input device located at the helm 74 of the marine vessel 52.

In FIG. 2, each diverter valve 68 has a bypass conduit 76 in the nature of one or more holes that extend through the diverter valve 68, through which the exhaust gas can freely pass when the diverter valve 68 is in the noted closed position. The present inventors have found that the bypass conduit 76 (in this example formed by the one or more holes in the diverter valve 68) advantageously reduces the above-described vibration and noise that was encountered in existing stern drive arrangements when the diverter valve 68 is in the closed position. The bypass conduit 76 permits a certain amount of exhaust gas to escape to atmosphere via the above-water outlet 70, which thereby reduces pressure in the secondary exhaust conduit 66 and thus reduces uncontrolled flow (i.e. leaks) of exhaust gas around the closed diverter valve, reduces exhaust gas bubbling through the underwater exhaust outlet on the stern drive arrangement, and reduces or eliminates rattling of the diverter valve. In other examples, instead of or in addition to the hole in the diverter valve 68, the bypass conduit 76 can be formed by a radially outer gap (space) between the diverter valve 68 and the inner diameter of the secondary exhaust conduit 66, such that the exhaust gas flows in a controlled manner, around the diverter valve 68 when the diverter valve 68 is in the closed position. The sizes of the bypass conduit 76 relative to the secondary exhaust conduit can be tuned based on characteristics of the stern drive arrangement to afford the above-mentioned advantages.

Figure 3:
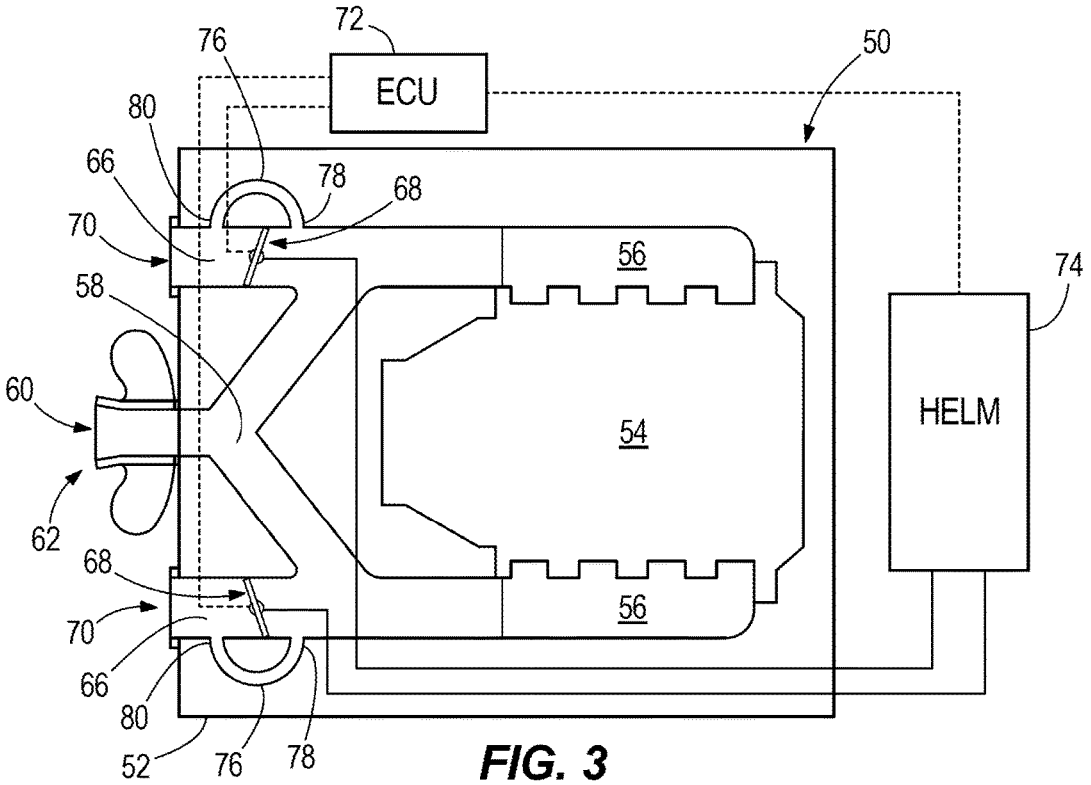
FIG. 3 is a schematic view of a second embodiment according to the present disclosure.

FIG. 3 depicts a second embodiment, which is like the first embodiment except that instead of having a bypass conduit 76 formed through each diverter valve 68, the bypass conduit 76 conveys the exhaust gas from an upstream outlet 78 on the secondary exhaust conduit 66 to a downstream inlet 80 on the secondary exhaust conduit 66, such that the exhaust gas can freely pass through the bypass conduit 76 and out of the above-water outlet 70, even when the diverter valve 68 is in the closed position. This can provide the same advantages discussed herein above regarding FIG. 2.

Figure 4:
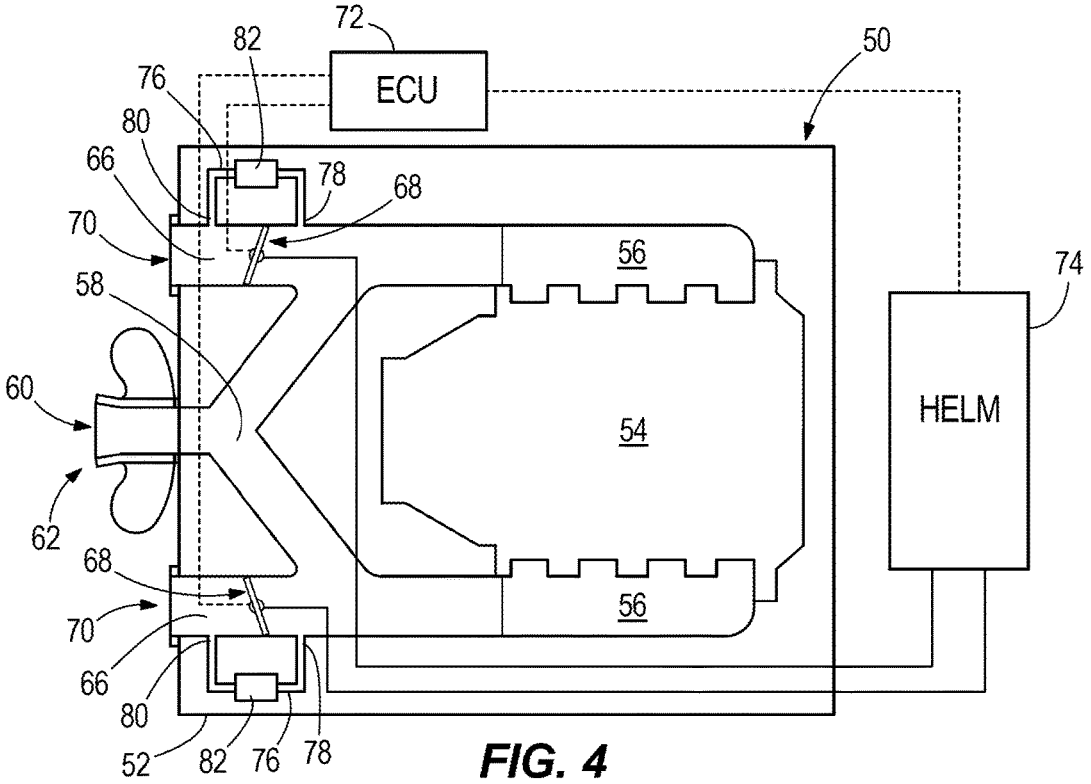
FIG. 4 is a schematic view of a third embodiment according to the present disclosure.

FIG. 4 depicts a third embodiment, which is like the second embodiment except the third embodiment further includes a silencer 82 in each bypass conduit 76. The silencer 82 is configured to further reduce exhaust noise in the bypass conduit 76 of the secondary exhaust conduit 66. The type and configuration of the silencer 82 can vary, and for example can be configured like the mufflers/silencers disclosed in above-incorporated U.S. Pat. No. 9,376,194 or U.S. patent application Ser. No. 15/174,201.

Figure 5:
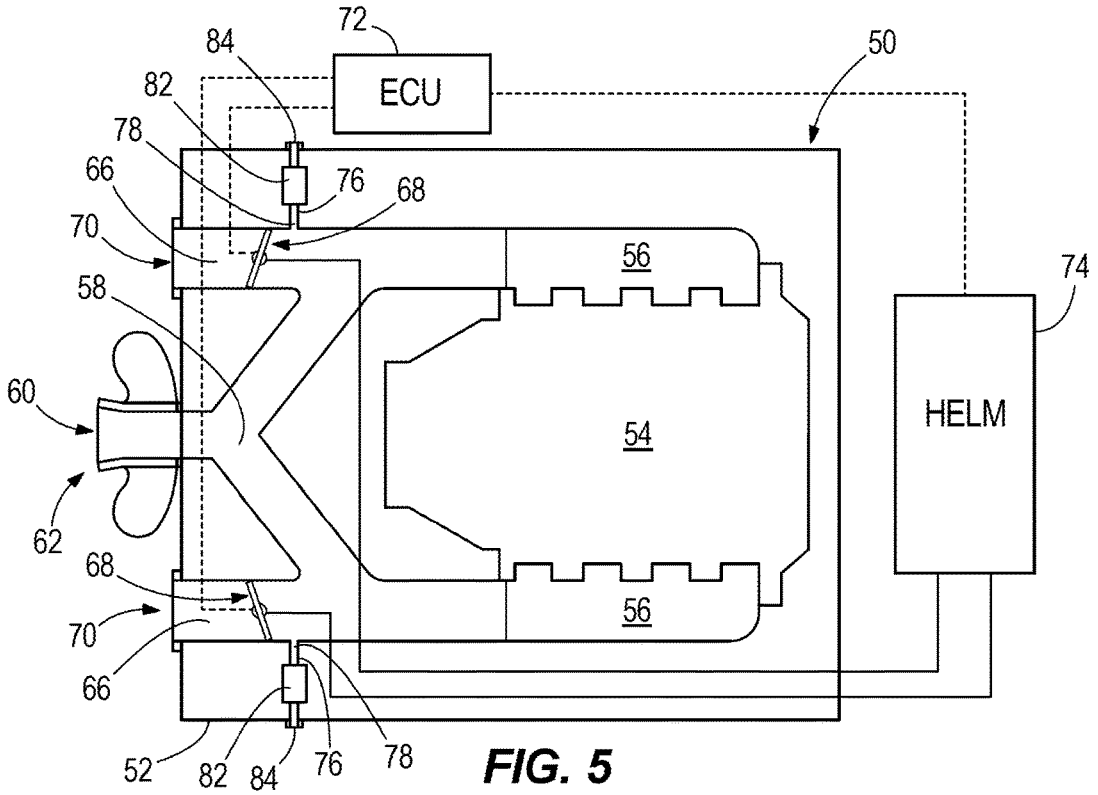
FIG. 5 is a schematic view of a fourth embodiment according to the present disclosure.

FIG. 5 depicts a fourth embodiment, which is like the third embodiment, except in the fourth embodiment the bypass conduit 76 conveys the exhaust gas from an upstream outlet 78 on the secondary exhaust conduit 66 to a downstream outlet (above water) 84 on the marine vessel 12. In the illustrated example, the downstream outlets 84 are formed in the port and starboard sides of the marine vessel 12, however in other examples either or both of the downstream outlets 84 could be formed in the transom 14 of the marine vessel 12. A silencer 82 is also disposed in the bypass conduit 76 for reducing exhaust noise there from. Similar to the embodiment of FIG. 4, the type and configuration of the silencer 82 can vary, and for example can be configured like the mufflers/silencers disclosed in above-incorporated U.S. Pat. No. 9,376,194 or U.S. patent application Ser. No. 15/174,201.

Figure 6:
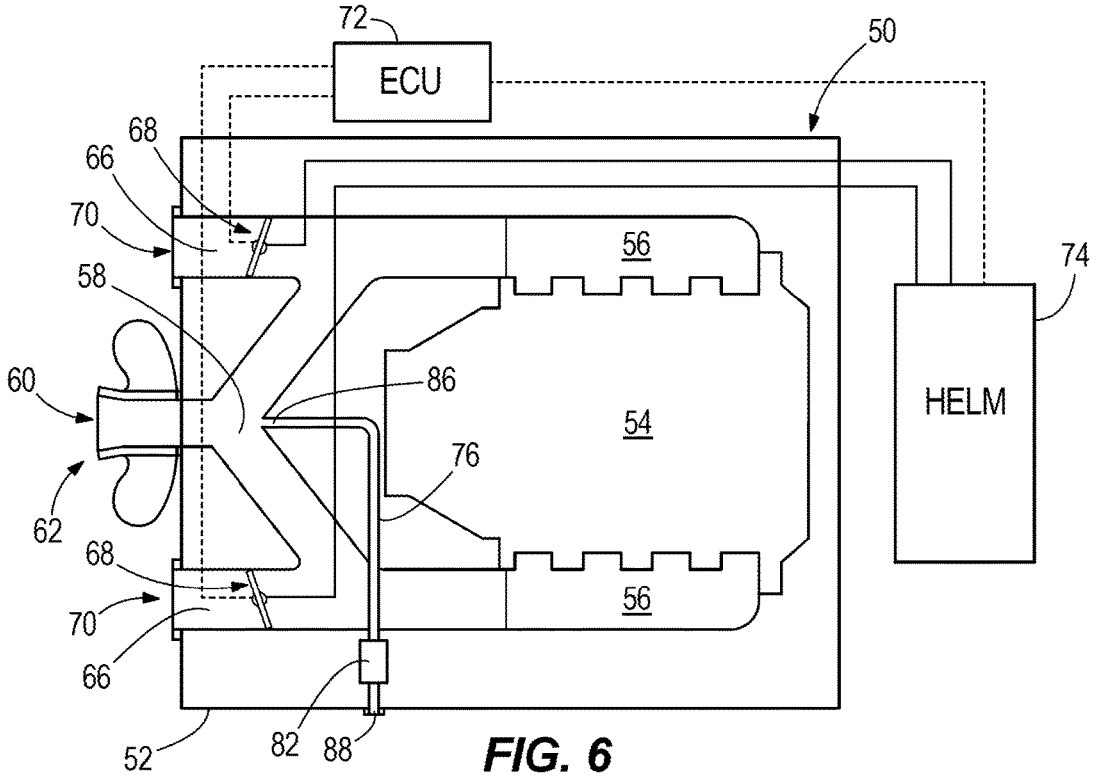
FIG. 6 is a schematic view of a fifth embodiment according to the present disclosure.

FIG. 6 depicts a fifth embodiment, which is like the first embodiment, except that instead of having a bypass conduit 76 for each secondary exhaust conduit 66, the bypass conduit 76 has an upstream outlet 86 on the primary exhaust conduit 58 and an above water downstream outlet 88 on the marine vessel. A silencer 82 is disposed in the bypass conduit 76, similar to the embodiments shown in FIGS. 4 and 5.

It should also be recognized that the different configurations of the bypass conduit 76 disclosed herein above can be combined in any manner. It is possible and can be advantageous to have a stern drive arrangement with any combination of the bypass conduit configurations of FIGS. 2-6.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims. Each limitation in the appended claims is intended to invoke interpretation under 35 U.S.C. Section 112(f), only if the terms "means for" or "step for" are explicitly recited in the respective limitation.

What is claimed is:

1. A stern drive arrangement for propelling a marine vessel in water, the stern drive arrangement comprising an internal combustion engine; an exhaust manifold that conveys exhaust gas from the internal combustion engine; a primary exhaust conduit configured to convey the exhaust gas from the exhaust manifold to an underwater outlet on one of the stern drive arrangement and the marine vessel; a secondary exhaust conduit configured to convey the exhaust gas from the exhaust manifold to an above-water outlet on one of the stern drive arrangement and the marine vessel; a diverter valve that is movable into and between an open position in which the exhaust gas is allowed to flow through the above-water outlet via the secondary exhaust conduit and a closed position in which the exhaust gas is at least partially prevented from flowing through the above-water outlet via the secondary exhaust conduit; and a bypass conduit configured such that the exhaust gas in the secondary exhaust conduit can bypass the diverter valve and discharge to atmosphere when the diverter valve is in the closed position, thereby reducing exhaust noise emanating from the above-water outlet and reducing exhaust gas discharged through the underwater outlet when the internal combustion engine is operated at idle speed.

2. The stern drive arrangement according to claim 1, further comprising a silencer configured to reduce exhaust noise in the secondary exhaust conduit.

3. The stern drive arrangement according to claim 1, wherein the exhaust gas is conveyed from upstream to downstream in parallel through the primary exhaust conduit and the secondary exhaust conduit.

4. The stern drive arrangement according to claim 3, wherein the bypass conduit conveys the exhaust gas from an upstream outlet on the secondary exhaust conduit to a downstream inlet on the secondary exhaust conduit.

5. The stern drive arrangement according to claim 3, wherein the bypass conduit conveys the exhaust gas from an upstream outlet on the secondary exhaust conduit to a downstream outlet on the marine vessel.

6. The stern drive arrangement according to claim 3, wherein the bypass conduit conveys the exhaust gas from an upstream outlet on the primary exhaust conduit to a downstream outlet on the marine vessel.

7. The stern drive arrangement according to claim 1, wherein the bypass conduit comprises a hole in the diverter valve through which the exhaust gas can pass when the diverter valve is in the closed position.

8. The stern drive arrangement according to claim 1, wherein the exhaust manifold is one of a pair of exhaust manifolds that convey exhaust gas from the internal combustion engine, and wherein the primary exhaust conduit merges the exhaust gas from the pair of exhaust manifolds.

9. The stern drive arrangement according to claim 8, wherein the secondary exhaust conduit is one of a pair of secondary exhaust conduits that convey the exhaust gas from the pair of exhaust manifolds, respectively, and wherein the diverter valve is one of pair of diverter valves that control flow of the exhaust gas in the pair of secondary exhaust conduits, respectively.

10. The stern drive arrangement according to claim 9, wherein the bypass conduit is one of a pair of bypass conduits through which the exhaust gas can bypass the pair of diverter valves and discharge to atmosphere.

11. The stern drive arrangement according to claim 10, further comprising a pair of silencers configured to reduce exhaust noise in the pair of bypass conduits, respectively.

12. A stern drive arrangement for propelling a marine vessel in water, the stern drive arrangement comprising an internal combustion engine; a lower gearcase that supports a propulsor that is operably connected to the internal combustion engine; an exhaust manifold configured to convey exhaust gas from the internal combustion engine; a primary exhaust conduit configured to convey the exhaust gas from the exhaust manifold to an underwater outlet on the propulsor; a secondary exhaust conduit configured to convey the exhaust gas from the exhaust manifold to an above-water outlet on one of the marine vessel and the stern drive arrangement; a diverter valve that is movable into and between an open position in which the exhaust gas is allowed to flow through the secondary exhaust conduit to the above-water outlet and a closed position in which the exhaust gas is at least partially prevented from flowing through the secondary exhaust conduit to the above-water outlet; and a bypass conduit configured such that the exhaust gas in the secondary exhaust conduit can bypass the diverter valve and discharge to atmosphere when the diverter valve is in the closed position, thereby reducing exhaust noise emanating from the above-water outlet and reducing exhaust gas discharged through the underwater outlet when the internal combustion engine is operated at idle speed.

13. The exhaust arrangement according to claim 12, wherein the exhaust gas is conveyed from upstream to downstream in parallel through the primary exhaust conduit and the secondary exhaust conduit.

14. The exhaust arrangement according to claim 12, wherein the bypass conduit conveys the exhaust gas from an upstream outlet on the secondary exhaust conduit to a downstream inlet on the secondary exhaust conduit such that the exhaust gas is permitted to discharge to atmosphere via the above-water outlet when the bypass valve is in the closed position.

15. The exhaust arrangement according to claim 12, wherein the bypass conduit conveys the exhaust gas from an upstream outlet on the secondary exhaust conduit to a downstream outlet on the marine vessel such that the exhaust gas is permitted to discharge to atmosphere via the downstream outlet on the marine vessel when the bypass conduit is in the closed position.

16. The exhaust arrangement according to claim 12, wherein the bypass conduit conveys the exhaust gas from an upstream outlet on the primary exhaust conduit to a downstream outlet on the marine vessel such that the exhaust gas is permitted to discharge to atmosphere via the downstream outlet on the marine vessel when the bypass conduit is in the closed position.

17. The exhaust arrangement according to claim 12, wherein the bypass conduit comprises a gap between the diverter valve and the secondary exhaust conduit through which the exhaust gas can pass when the diverter valve is in the closed position such that the exhaust gas is permitted to discharge to atmosphere via the above-water outlet when the bypass valve is in the closed position.

18. The stern drive arrangement according to claim 12, wherein the exhaust manifold is one of a pair of exhaust manifolds that convey exhaust gas from the internal combustion engine, and wherein the primary exhaust conduit merges the exhaust gas from the pair of exhaust manifolds; wherein the secondary exhaust conduit is one of a pair of secondary exhaust conduits that convey the exhaust gas from the pair of exhaust manifolds, respectively, and wherein the diverter valve is one of pair of diverter valves that control flow of the exhaust gas in the pair of secondary exhaust conduits, respectively, and wherein the bypass conduit is one of a pair of bypass conduits through which the exhaust gas can bypass the pair of diverter valves and discharge to atmosphere; further comprising a pair of silencers configured to reduce exhaust noise in the pair of bypass conduits, respectively.

19. A stern drive arrangement for propelling a marine vessel, the stern drive arrangement comprising an internal combustion engine; an exhaust manifold that conveys exhaust gas from the internal combustion engine; a primary exhaust conduit configured to convey the exhaust gas from the exhaust manifold to an underwater outlet on the stern drive arrangement; a secondary exhaust conduit configured to convey the exhaust gas from the exhaust manifold to an above-water outlet on the marine vessel; a diverter valve that is movable into and between an open position in which the exhaust gas is allowed to flow through the secondary exhaust conduit and a closed position in which the exhaust gas is at least partially prevented from flowing through the secondary exhaust conduit; a bypass conduit through which the exhaust gas in the secondary exhaust conduit can bypass the diverter valve and discharge to atmosphere when the diverter valve is in the closed position, thereby reducing exhaust noise emanating from the above-water outlet and reducing exhaust gas discharged through the underwater outlet when the internal combustion engine is operated at idle speed; and a computer controller configured to control a position of the diverter valve.

20. The stern drive arrangement according to claim 19, further comprising a user input device, wherein the computer controller controls the position of the diverter valve based upon an input from the user input device.

* * * * *